US008588032B2

(12) United States Patent
Geyer et al.

(10) Patent No.: US 8,588,032 B2
(45) Date of Patent: Nov. 19, 2013

(54) ELECTRONICALLY CONTROLLED WATCH

(76) Inventors: Michael Geyer, Vienna (AT); Franz Krieger, Vienna (AT); Silvia Krieger, legal representative, Vienna (AT)

( * ) Notice: Subject to any disclaimer, the term of this patent is extended or adjusted under 35 U.S.C. 154(b) by 810 days.

(21) Appl. No.: 12/602,007

(22) PCT Filed: May 25, 2008

(86) PCT No.: PCT/AT2008/000176

§ 371 (c)(1),
(2), (4) Date: Jun. 28, 2010

(87) PCT Pub. No.: WO2008/144786

PCT Pub. Date: Dec. 4, 2008

(65) Prior Publication Data

US 2011/0182151 A1 Jul. 28, 2011

(30) Foreign Application Priority Data

May 25, 2007 (AT) ..... A 835/2007

(51) Int. Cl.

| | |
|---|---|
| ***G04C 19/00*** | (2006.01) |
| ***G04C 17/02*** | (2006.01) |
| ***G04G 9/04*** | (2006.01) |
| ***G04G 9/00*** | (2006.01) |
| ***G04G 17/08*** | (2006.01) |

(52) U.S. Cl.

CPC ..... *G04G 9/04* (2013.01); *G04G 9/0017* (2013.01); *G04G 17/083* (2013.01)

USPC ..... 368/82; 368/11; 368/240

(58) Field of Classification Search

USPC ..... 368/82–84, 239–242

See application file for complete search history.

(56) References Cited

U.S. PATENT DOCUMENTS

| | | | | | |
|---|---|---|---|---|---|
| 1,096,682 | A | * | 5/1914 | Clement | 368/240 |
| 3,509,715 | A | * | 5/1970 | De Koster | 368/240 |
| 3,633,355 | A | * | 1/1972 | Sakata | 368/296 |
| 3,757,511 | A | * | 9/1973 | Burgess et al. | 368/83 |
| 3,908,355 | A | * | 9/1975 | Wiesner | 368/79 |
| 3,922,847 | A | * | 12/1975 | Culley et al. | 368/240 |
| 3,955,354 | A | * | 5/1976 | Kilby et al. | 368/240 |
| 3,955,356 | A | * | 5/1976 | LeCocq | 368/225 |
| 3,958,409 | A | * | 5/1976 | Manber | 368/240 |
| 3,968,639 | A | * | 7/1976 | Berets et al. | 368/84 |
| 4,007,583 | A | * | 2/1977 | Johnson | 368/29 |
| 4,095,414 | A | * | 6/1978 | Reich | 368/83 |

(Continued)

FOREIGN PATENT DOCUMENTS

| | | | |
|---|---|---|---|
| DE | 20208330 | U1 | 8/2002 |
| GB | 2162663 | A | 2/1986 |
| GB | 2297021 | A | 7/1996 |

*Primary Examiner* — Vit W Miska

(74) *Attorney, Agent, or Firm* — David A. Guerra

(57) ABSTRACT

Watch which is controlled electronically and whose housing (1) and display field are in the form of a ring, wherein the watch displays are formed by lighting means (3) and (4) which can be switched such that they circulate on the ring, and wherein at least one annular row of at least 60 light-emitting diodes (LEDs) (16) indicates at least the time parameters of 'hour' and 'minute', preferably additionally the time parameter of 'second', by means of the luminous state of individual LEDs, and an electronic printed circuit board (2) which is used as the annular display field is arranged on one of the ring end faces, and the displays of hours, minutes and seconds differ from one another by virtue of the luminous pattern and/or the luminous color and/or the brightness and/or the luminous distribution among a plurality of adjacent LEDs.

19 Claims, 6 Drawing Sheets

(56) References Cited

U.S. PATENT DOCUMENTS

| | | | | | |
|---|---|---|---|---|---|
| 4,473,304 | A * | 9/1984 | Ketner | 368/281 |
| 4,525,077 | A * | 6/1985 | Ketner | 368/77 |
| 4,702,615 | A * | 10/1987 | Havel | 368/82 |
| 4,920,524 | A * | 4/1990 | Kotob | 368/240 |
| 5,189,408 | A * | 2/1993 | Teicher | 340/815.4 |
| 5,694,376 | A * | 12/1997 | Sullivan | 368/82 |
| 6,522,381 | B1 * | 2/2003 | Brandt | 349/142 |
| 6,683,822 | B2 * | 1/2004 | Cheng | 368/240 |
| 6,690,623 | B1 * | 2/2004 | Maano | 368/82 |
| 2005/0276164 | A1 * | 12/2005 | Amron | 368/82 |
| 2006/0062089 | A1 * | 3/2006 | Lizzi | 368/240 |

* cited by examiner

ELECTRONICALLY CONTROLLED WATCH

CROSS-REFERENCE TO RELATED APPLICATIONS

This application is an U.S. national phase application under 35 U.S.C. §371 based upon co-pending International Application No. PCT/AT2008/000176 filed on May 5, 2008. Additionally, this U.S. national phase application claims the benefit of priority of co-pending International Application No. PCT/AT2008/000176 filed on May 20, 200 and Austria Application No. A 835/2007 filed on May 25, 2007. The entire disclosures of the prior applications are incorporated herein by reference. The international application was published on Dec. 4, 2008 under Publication No. WO 2008/144786.

The invention relates to an electronically controlled time piece, the casing and display field of which are in the form of a ring, the time piece displays being formed by illuminated points orbiting on the ring.

STATE OF THE ART

Portable watches in ring form are known from WO 01/88638 A1. Here, the timing unit, time display and source of power are integrated in a bracelet, the time display extending over a portion of the bracelet circumference and being composed of electronically controllable digits. The essential feature of a watch of this type is the design of the combination and structural integration of bracelet and watch casing.

CH 613 599 G A3 and NL C 1012053 show that the displays of analogous time piece hands may be replaced by electric illuminating means. The time display is brought about there by means of circularly-arranged light-emitting diodes (LEDs), representing the positions of the tips of hour and minute hands. The state of illumination of one of these LEDs indicates the position of a defined hand. Both disclosures have in common that [both] the time piece casings are configured as conventional flat cylinders or disks, the number of the hour-indicating LEDs being twelve only permitting the indication of full hours. In this case, an intermediate position of the hour display as is the case for analogous time pieces and also desired for facilitating the reading of time, is not possible.

From GB 2 218 895 A a wristwatch is known comprising a watch casing in the form of a perforated disk which uses a system of LED's to display the time.

GB 2 162 663 A discloses a wristwatch comprising an annular watch casing, wherein LEDs, arranged in a circle, replace the position of analogous watch hands in the state of illumination. In this case, minutes and hours are displayed in two separate LED-circles. This necessitates widening of the casing and results in the appearance of the watch as a whole approximating that of a conventional watch casing more than an annular watch. GB 2 162 663 A as well as GB 2 218 895 A cited above have in common that the watch casings have the shape of a perforated disk, as the size of the remaining space for accommodating an electric source, timing electronics and display means does not differ substantially from disk- or flat cylinder-like watch casings for wristwatches.

The teachings of DE 3 806 561 A1 reside in a process to convert digital timing into a time display which is brought about electrically and appears analogously. Circular, quadrangular or triangular time piece casings the central parts of which have been left open, are disclosed as possible embodiments, wherein the time display is brought about by the states of illumination of three concentric LED-rows replacing the positions of analogous second-, minute- and hour hands. As a result, this design, like GB 2 162 663 A, suffers from the drawback of using a great number of LEDs, necessitating a broad annular band as time piece casing and creating an awkward appearance.

GB 2 384 063 A adds to the state of the art a watch having an annular casing which can be worn as a (finger) ring or bracelet. The time is displayed by the position of two indicators provided for hours and minutes, orbiting on the periphery of the ring, or by a central ring with a printed on digit sequence moving past a stationary indicator.

GB 2 409 295 A shows a watch with an annular casing, which may be worn as a finger-, ankle ring or as a bracelet. As time indicators either the orbiting light of one LED of one LED-ring or the orbiting light of two LEDs of two LED-rings are provided. Analogously to GB 2 384 063 A cited above, the LEDs are located on the periphery of the ring. Analogously to GB 218 895 A, GB 2 162 663 A as well as DE 3 806 561 A1 two separate LED-rings are necessary for a time display, the reading of which is accurate to the minute.

All patent specifications cited, to the extent that they disclose wristwatches in annular- or perforated disk-like watch casings, either do not state a process for setting the time or attribute the latter to the means of adjusting knobs already known from time piece technology. In this context, one or more electronic press buttons are controlled via mechanical knobs (winding buttons). Winding buttons, due to their size and mechanical demands, represent an important factor, determining the minimum dimension of the watch casing and the appearance of the watch as a whole.

It is therefore the object of the invention to provide a time piece of the type set out in the opening paragraph, preferably in the form of a wristwatch, the ring thickness of which is designed as small as possible in relation to the ring diameter, the minute-, hour- and second display of which takes place on a single ring of LEDs.

This object is attained according to the invention in that an annular row of light-emitting diodes (LEDs) by way of the state of illumination of individual LEDs indicates the time parameters of "hour" and "minute", preferably additionally the time parameter "second", and the annular display field is provided on one of the end faces of the ring.

Thus, advantageously all elements of a circular time piece which are not directly required for time display, are omitted or accommodated at localities where they do not contribute to the optical appearance. This form of reduction eliminates the entire interior of the time piece where normally hands, clockwork or batteries are located. What remains is a thin ring of a few millimeters on which constantly illuminated points display the time by way of their angular position on the ring.

According to a preferred embodiment of the invention, the displays of hours, minutes and seconds differ from one another by virtue of the illumination design and/or the illumination color and/or the brightness and/or the illumination distribution onto a plurality of adjoining LEDs.

According to a further feature of the invention, it is provided that the time piece casing is composed of at least one annular member comprising a groove, in which the inserted and fixed display electronics are enclosed by a transparent material.

Further features of the invention are elucidated in more detail in what follows by way of the embodiments shown in the drawings.

FIGS. 3*a* to 3*e* show display possibilities of hours, minutes and seconds on a joint ring of LED's.

Figure 4:
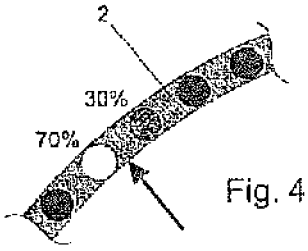
Figure 7E:
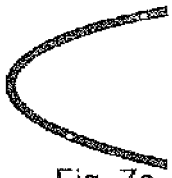

FIG. 4 shows the display of a time value intermediate between two LEDs.

Figure 5:
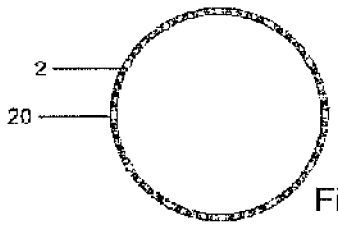
Figure 6A:
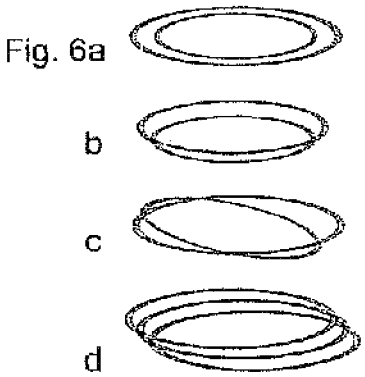

FIG. 5 shows the use of a pattern of LEDs as time marking.

FIGS. 6*a* to 6*d* show arrangements of a plurality of time rings.

FIGS. 7*a* to 7*e* show possible variations of the ring deformations out of the ring plane.

Figure 8:
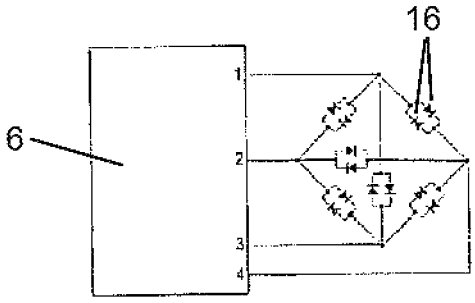

FIG. 8 shows a circuit diagram for controlling four LEDs.

Figure 9A:
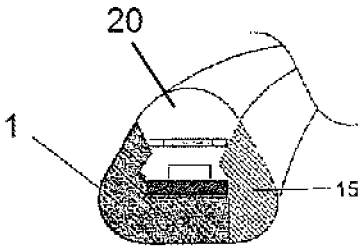
Figure 9B:
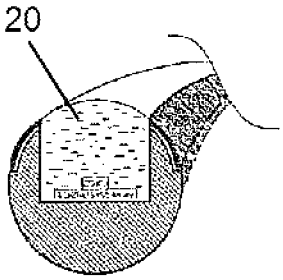
Figure 9C:
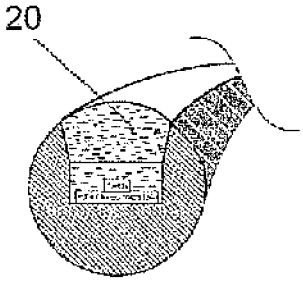

FIGS. 9*a* to 9*c* show alternative configurations of the time piece ring.

Figure 10:
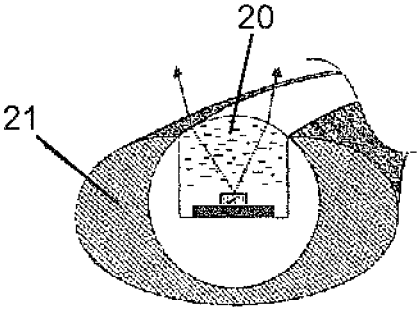

FIG. 10 shows a cross-section through the circumferential band of the time piece ring with a further surrounding material and the manner in which the casting mass is molded for an optical lens effect.

Figure 11:
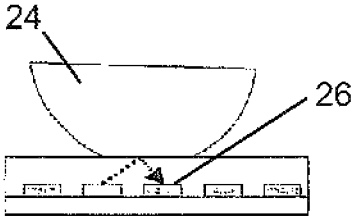

FIG. 11 shows the process of a switch activation by touching the time display with the tip of a finger.

Figure 12A:
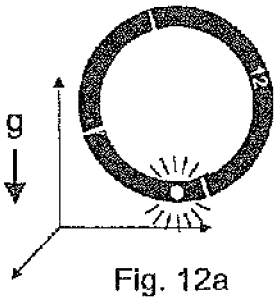
Figure 12B:
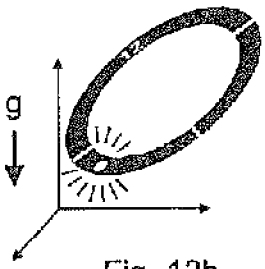
Figure 12C:
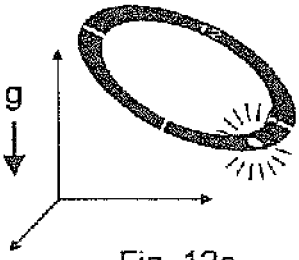

FIGS. 12*a* to 12*c* show the positions of an illuminated point on the time piece ring which orientate themselves according to gravity.

Figure 13A:
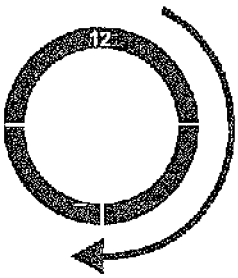
Figure 13B:
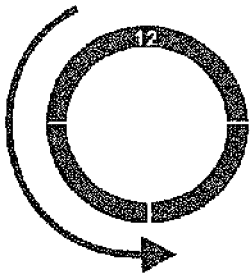

FIGS. 13*a* and 13*b* show the direction of rotation of a finger passing over the time piece ring in order to adjust the time.

Figure 14:
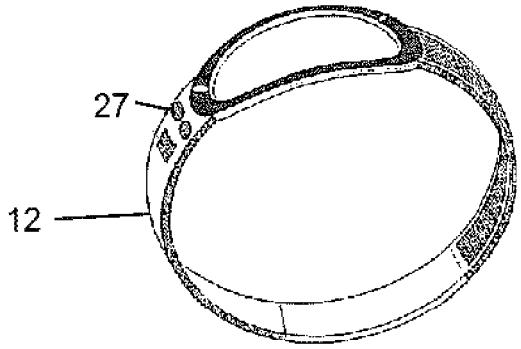

FIG. 14 shows the arrangement of input elements and power supply of the wristwatch in the wrist strap.

Figure 15:
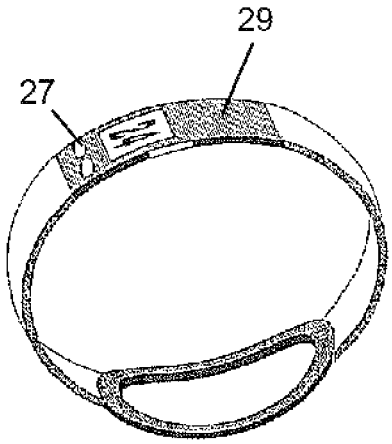

FIG. 15 shows the arrangement of input and output elements in the clasp.

Figure 16A:
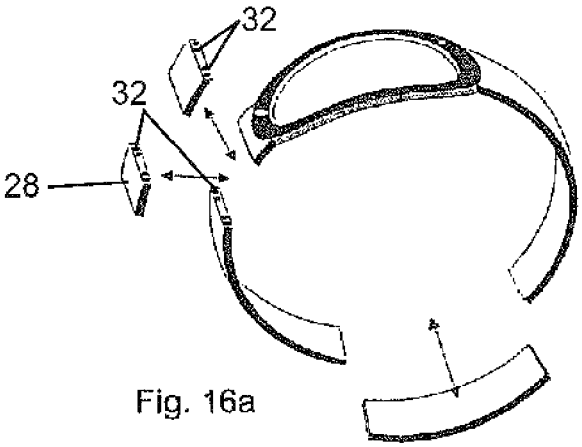

FIG. 16*a* shows the modular dismantlability of the watch strap.

Figure 16B:
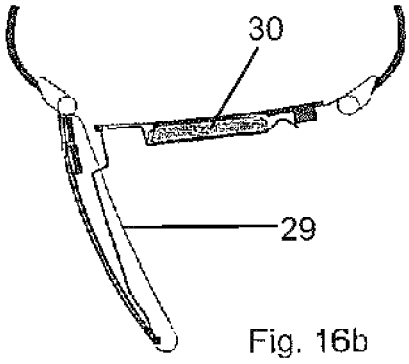

FIG. 16*b* shows a clasp design with a secure lock, including at the same time a battery installed and sealed therein in watertight manner.

Figure 17A:
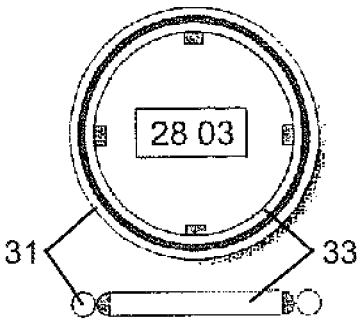
Figure 17B:
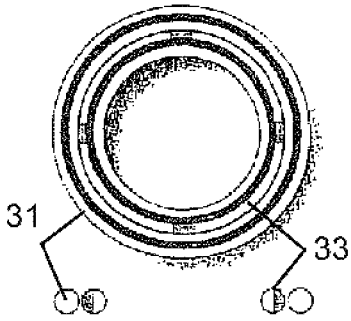

FIGS. 17*a* and 17*b* show two embodiments of center elements which may temporarily be inserted in the center portion of the annular time piece.

Figure 18:
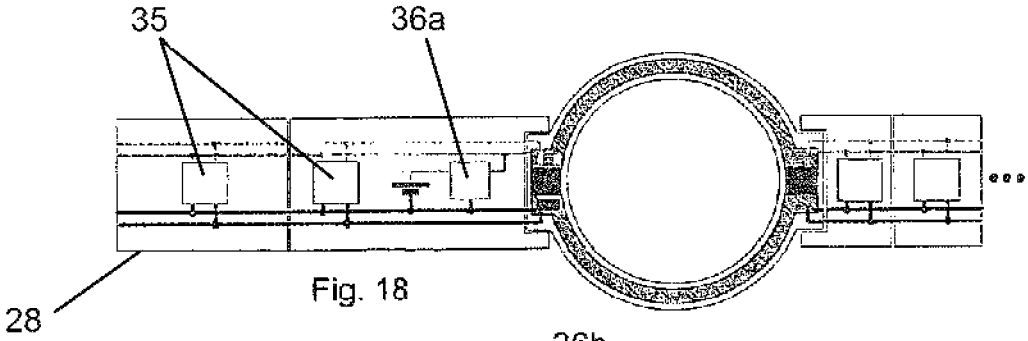

FIG. 18 shows the arrangement of step-up converters and electronic modules in the watch strap.

Figure 19A:
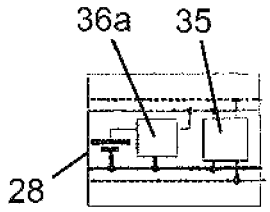
Figure 19B:
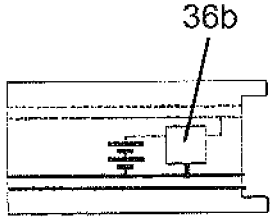
Figure 19C:
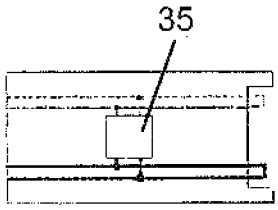

FIGS. 19*a* to 19*c* show installation modes for modules of the watch strap comprising power- and/or data conductors.

Figure 20:
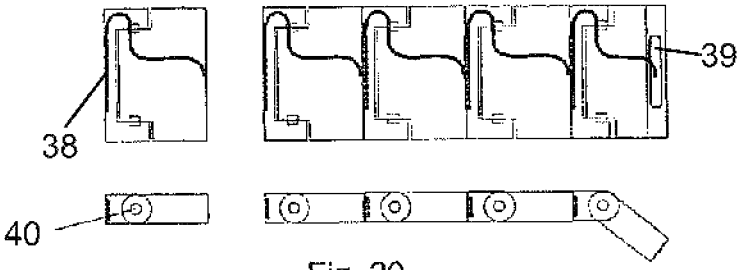

FIG. 20 shows the modular linkage of individual elements of the watch strap, provided for the conductance of electric current.

Figure 21:
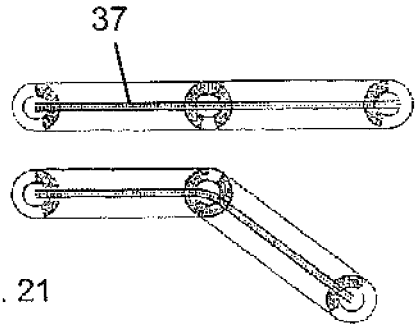

FIG. 21 shows the buckling protection for electric conductors in the flexible watch strap.

Figure 22:
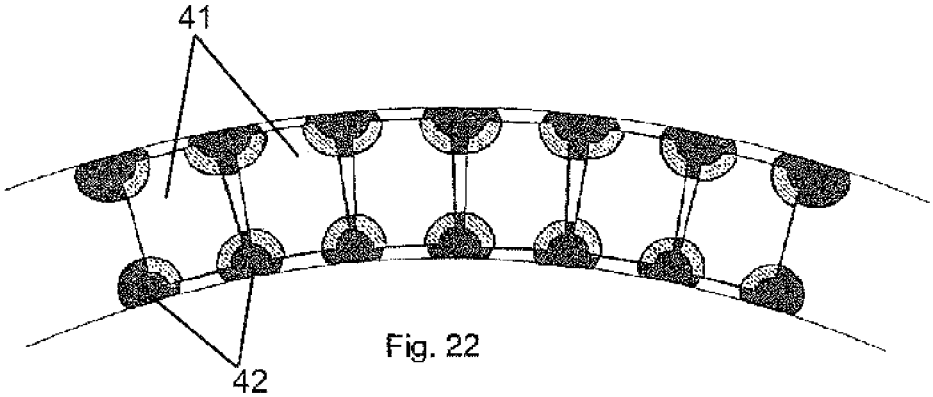

FIG. 22 shows a section of the arrangement of LEDs on an annular printed circuit board.

Figure 23:
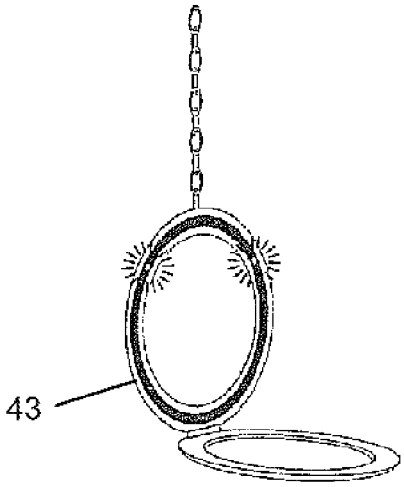

FIG. 23 shows the embodiment of the annular time piece as a pocket watch.

Figure 24:
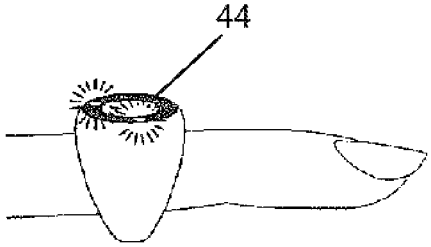

FIG. 24 shows the embodiment of the annular time piece as a finger ring.

Figure 25:
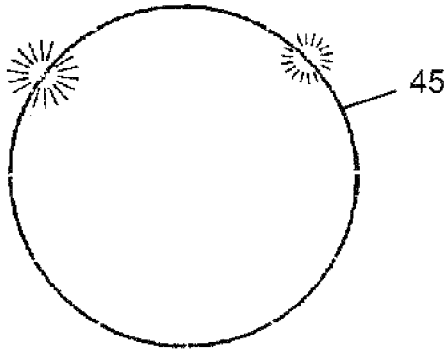

FIG. 25 shows the embodiment of the annular time piece as a wall clock.

Figure 26:
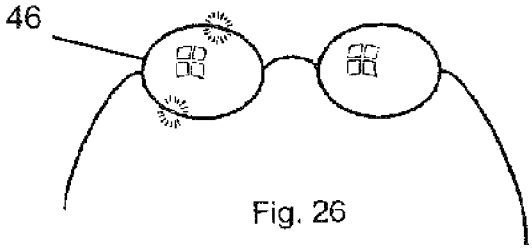

FIG. 26 shows a pair of spectacles around the lenses of which a time piece ring is disposed.

Figure 1:
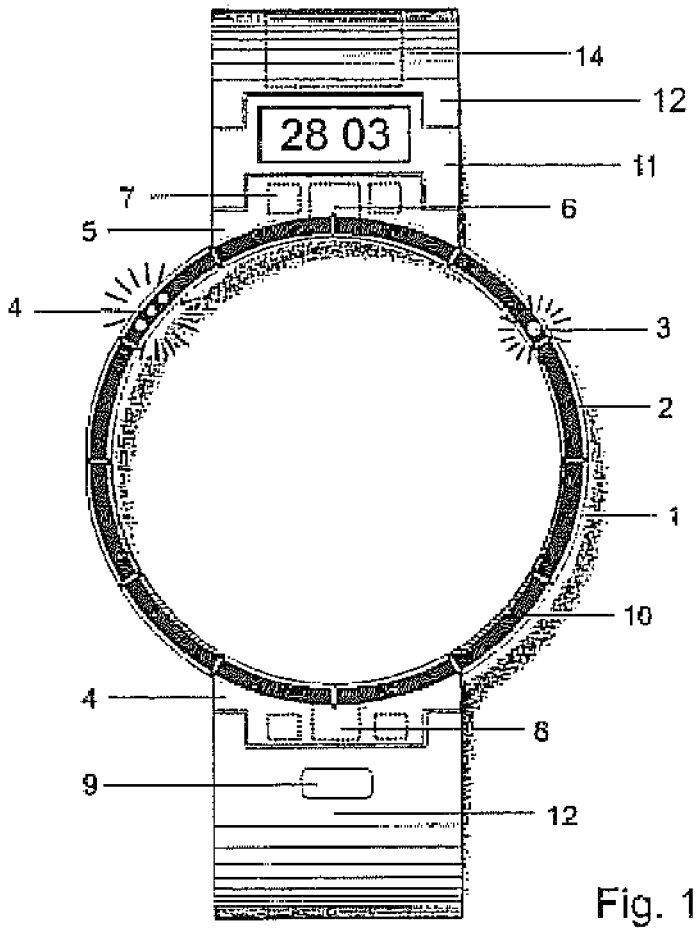
FIG. 1 shows an annular time piece in plan view, designed as a wristwatch.
Figure 2:
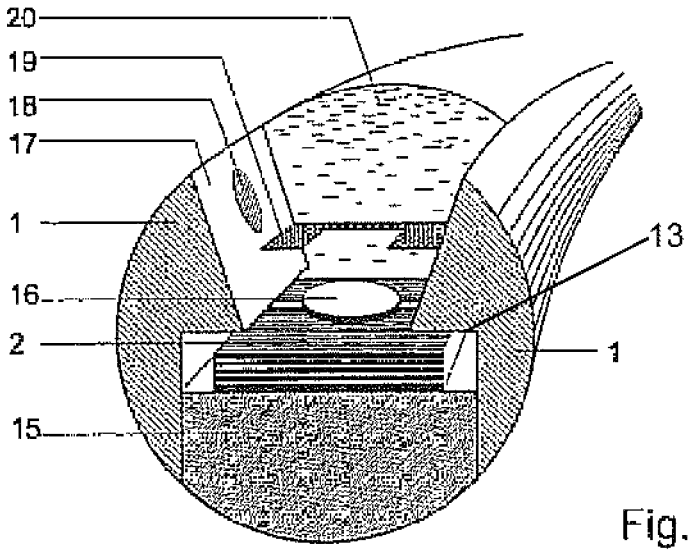
FIG. 2 shows a cross-section of the circumferential band of the watch ring.
Figure 3A:
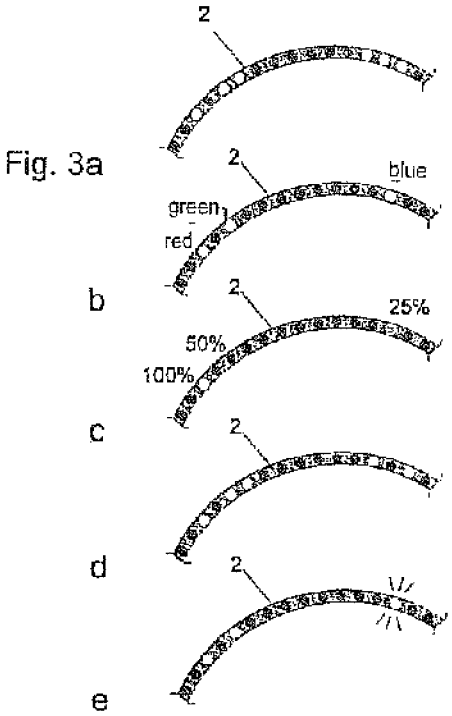

According to FIGS. 1 and 2 electronic printed circuit boards 2 are lying embedded in the groove 13 of a thin steel ring 1, whereon a multiple of 12, in particular 60, preferably multi-colored light-emitting diodes (LEDs) 16, placed in a row, are located, which are able to display hours, minutes, seconds and further information. Various parameters are displayed here on a single circle of LEDs; differentiation is brought about by the illumination color, brightness, number of illuminating LEDs or graphic illumination design or a chronological variation of the above cited parameters (e.g. blinking, pulsing, flickering, FIGS. 3*a* to 3*e*). The width of the ring thus depends only on the technically-realizable thickness of the illuminating elements and may therefore fall below all solutions known to date.

The illumination colors and shapes of display parameters are advantageously so selected that overlappings do not result in obscuring parameters. Thus, it is advantageous, for example, to symbolize the hour display by 2-4 points located one behind the other, illuminated only at half the brightness, while the minutes are symbolized by a single point illuminated at full brightness. These display symbols may thus be superimposed and nevertheless be recognized individually. Distinguishing between the parameters is also possible by using different illumination colors. If the number of points, color and blinking rhythm are used for coding, many parameters may be represented simultaneously on the same circle.

According to the invention the hour position is indicated by a fine scale, including more than 12 positions, preferably 60 possible positions. Accordingly, at 10:30 the hour point is not illuminated at 10 or 11, as is the case in conventional time pieces, which may result in confusion, but between 10 and 11, analogously to a time piece comprising hands.

In addition, positions between two illuminated points can be so displayed that both adjacent points share the overall brightness of an individual point in a particular ratio so that a point which is closer to the exact position is illuminated brighter (display technology of anti-aliasing). If the calculated position of a point is situated, e.g. exactly between two LEDs, these LEDs are then both controlled at half the brightness. If the position is closer to one LED, this LED is controlled to be brighter while the other LED is controlled to be darker, exactly in the ratio of the distances between the exact illuminated position and the two displaying LEDs (FIG. 4).

Accordingly, this solution thus imitates the graduation of an analogous time piece comprising hands which, in theory, may be to any desired degree of fineness. In this manner, the effect of a continuously adjustable and constantly moving point (e.g. a second point) can be attained as well.

The hour- and minute display points are permanently illuminated and can adapt to the ambient brightness by way of a brightness sensor. Power consumption of the time piece may thus be lowered in darker environments.

If the ambient brightness drops below a determined value and if, as a result thereof, the printed on time markings can no longer be read in darkness, illuminating elements (preferably blue) are activated on the hour, taking over the time markings of the full hours. For accurate orientation the 3 o'clock, 6 o'clock, 9 o'clock and 12 o'clock positions are in this case shown brighter or in different color, the 12 o'clock position being specially emphasized in this context, e.g. by the lighting up of three points adjoining one another.

For the time display a LED-number of 60 is preferred. An even higher resolution can be attained by a LED-number which is preferably a whole number multiple of 60. If smaller ring diameters are required, a smaller number of LEDs is used, but preferably a whole number multiple of 12. Due to anti-aliasing technology, a permanent image of the time display may also be attained by an LED-number which is only a whole number multiple of 12. For orientation and a better estimate of the exact time it is sensible to also arrange 5-minute markings along the ring.

The LEDs are connected to the processor 6 via conductors embedded in the annular printed circuit board. This processor has outputs which can be switched to either have high resistance or be switched to low or high. The anode and cathode of each LED are both so connected to these outputs that both connections of each LED differ by at least one output. In other words, the maximum controllable LED-number is attained if each output is connected to any one of the other outputs via two anti-parallel connected LEDs. With n outputs one can thus control n·(n−1) LEDs. (Example: 4 outputs, 12 LEDs, FIG. 8). With 16 outputs one can control 16·15=240 LEDs, thus attaining the minimum number of 60·3=180 LEDs required for an optimal full-color time piece display.

If no LED is illuminated, all outputs have high resistance; if a particular LED should be illuminated, its anode is switched to low, the cathode to high. As in this manner only one single LED each can be controlled simultaneously, these—if a plurality of LEDs are to be illuminated—must be controlled sequentially, preferably at a frequency which is higher than the threshold frequency of the human eye so that no flickering can be perceived, i.e. greater than 50 Hz preferably 128 Hz.

The display of time is brought about in that those positions are optically high-lighted by the LEDs, for example by the lighting up of a color point, to which the hand of a time piece comprising hands would point. However, the time markings themselves (e.g. the full hours) or, respectively, wake-up times, stop times, alarm times etc. can be represented by the LEDs (FIG. 5) For these various times to be distinguishable from one another, they must differ in their optical characteristics, e.g. color, brightness, graphic design, motion pattern, chronological variations.

To differentiate between hours, minutes and seconds basically any color variants are possible, preferably hours are marked by one or a plurality of red color points, minutes by a green point, seconds by a blue point and the 12 hour markings by a blue point. In order to be able to better read the display in a bright environment, the display points may also pulsate or cyclically change their color (both preferably at ca. 1-4 Hz).

If the 12 hour markings are not fixed on the time piece ring but displayed by LEDs, the angular position of the entire display can be turned by the processor as desired. If, e.g. the time piece is moved, its position in space is determined by means of the integrated position sensor; the processor will then always turn the entire display in such a manner that the 12 o'clock position is always at the gravimetrically highest point of the time piece.

The display points can be modified by the processor with regard to their brightness. This is preferably attained by pulse width modulation. As a result, both soft brightness transitions (anti-aliasing) as well as an automatic adaptation to the ambient brightness can be attained. Measuring the ambient brightness is done either by measuring the reverse bias current of the display-LEDs itself (FIG. 11), or by an independent brightness sensor.

The position or acceleration sensor integrated in the time piece can determine if the time piece is moved or retained in a specific position and can, consequently, again increase or reduce the brightness of the display, if required (in order to save power). If, for example, the hand is hanging downwards, it can be assumed that the time is not read, and the display is darkened. If the time piece is positioned approximately horizontally, it can be assumed that the time is being read and the display is adjusted to a brighter setting. If the time piece is moved (intentionally) vigorously, the display can be adjusted to a particularly bright setting.

A plurality of such display rings may be disposed in various spatial positions, in order, e.g. to display different time zones or further parameters simultaneously, even overlapping or in several planes (FIGS. 6*a* to 6*d*).

Figure 7A:
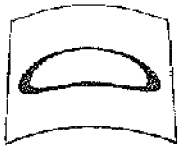
Figure 7B:
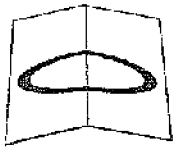
Figure 7C:
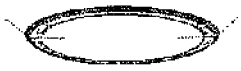
Figure 7D:
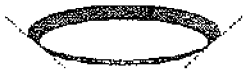

The display rings do not necessarily have to be circular, but may take any shape, e.g. oval, triangular, quadrangular and polygonal. The surface on which the rings are lying need not necessarily be level. It may also be curved or have folds (FIGS. 7*a* and 7*b*). The display rings themselves may likewise be folded (FIG. 7*c*) or conically curved (FIG. 7*d*). The LEDs may also be situated on one or a plurality of open curves.

The energy source 14, for reasons of space, is not arranged in the time piece ring, but outside, preferably in the watch strap 12 or in the clasp 29, to which the time piece ring is electrically connected. Compared with accommodation in the time piece casing, the external energy supply, due to the higher volume, permits substantially longer time periods between accumulator recharge and battery replacement or a brighter display.

Preferably, flexible accumulators 35, e.g. lithium-polymer-rapid charge accumulators, integrated in the wrist strap, are to be used. Charging can be performed over the lateral edges of the wrist strap: one side of the watch strap forms the plus pole, the other one the minus pole—this prevents an accidental short-circuit of the contacts by touching metallic objects.

The charger for the integrated accumulators may be grid-powered, preferably, however, it is grid-independent, either battery-operated or self-charging. The time piece can thus also be charged while traveling.

A battery 30 may also be accommodated in the clasp 29 of the time piece. This is attained by a clasp design which encloses the battery in a watertight manner and nevertheless ensures reliable locking of the watch strap (FIG. 16*b*).

The time piece ring is supplied with constant voltage (preferably 5 V), which is made available by the power supply elements. This ensures uniform illumination of the LEDs of the annular time piece over the entire serviceable life of the battery or the accumulator. The time piece comprises a small condenser 7, located parallel to the power supply, being therefore constantly charged and ensures the power supply of the time piece for a certain period of time during battery or module replacement. If the voltage in the time piece drops below a specific value, this is recognized by the processor, it goes into sleep mode and switches off all power consuming elements (LEDs, A/D converter etc.), not directly required for time reporting.

The watch strap module 28 with integrated accumulator 35 has its own electronics part which converts the voltage (typically 3.7 V) supplied by the accumulator to 5 V by way of a step-up converter 36*a* (FIG. 18). If the accumulator supplies a higher voltage (e.g. by connection in series of two accumulators), the voltage is reduced to 5 V by a step-down converter 36*b*.

If the power supply is brought about via the clasp module, this likewise contains its own electronics part converting any input voltage between 0.9 and 4 V to constant 5V.

The micro-processor, taking over all functions of the time piece, including the control of the LEDs, is accommodated, together with the time piece quartz and other electronic components, in bulges 4 and 5 at the upper and lower end of the time piece ring (FIG. 1). The watch strap is also fitted to these bulges. All components necessary for the operation of the time piece may, however, also lie directly on the underside of the annular printed circuit board, which also carries the display-LEDs, or may actually be situated outside the time piece ring, and be connected to the latter via flexible conductor tracks 37.

The micro-processor runs preferably at a pulse frequency exceeding 1 MHz in order to operate the display in a flicker-free manner and be able to execute other programs. This frequency need not be quartz-stabilized. The time basis for the time piece, on the other hand, is given by a time piece quartz, feeding its signal in an input of the processor.

For reasons of space, the time piece ring also no longer includes mechanical input elements, such as e.g. a winding button. The operation of the time piece is performed either via external input elements 27 in the wrist strap (FIG. 14) or in the clasp (FIG. 15), preferably, however, via touch-sensitive sensors on the time piece ring, i.e. via the LEDs of the time display themselves, which are used as reflective light barriers 25 and 25, in that, as already known, its "reverse bias" current is measured (FIG. 11). Alternatively, the input is also possible via the technology of "simulated mass point" or by tapping onto the casing.

In the wrist strap or in the clasp 29 input elements 27 (scanners, sensor elements) may be accommodated which are electrically connected to the time piece ring.

Adjusting and operating the time piece may be performed by the LEDs of the display themselves: by measuring the leakage current in reverse biased LEDs it can be determined whether the tip of a finger 24 is present over the LED: in this case the finger acts like a reflector for the light of an adjacent LED and illuminates the sense-LED 26, whereupon the resistance thereof drops, which, as already known, can be recognized and evaluated by the micro-processor. Localities for the use of a sense-LED are, e.g. the 3-, 6-, 9- or 12 positions, because at these localities an LED must illuminate so that the adjacent LED can function as a sense-LED. At the beginning of an input e.g. two LEDs (e.g. "3" and "9") opposite one another on the ring must be touched simultaneously, or another switching element (e.g. in the clasp or the watch strap) must be operated in order to avoid accidental operating errors.

If the time piece is operated via sensors 10 on the time piece ring, the time piece casing is designed in electrically-conductive fashion. Inside this casing sensor sections are provided which are electrically isolated from the casing. Preferably, these sensor sections are situated on the inner ring and can again be subdivided there and fill out the space between two time markings. The sensor sections, like the casing, are connected to the processor. If the finger is placed on a sensor section and the gap between the casing and the sensor is bridged, low current can flow between the sensor element and the casing over the tip of the finger which is recognized by the processor, triggering a switching event. It also suffices however to only tap a sensor element alone: in this case, low current flows into the sensor from the underside of the time piece via the body and the tip of the finger, which, in turn, triggers a switching event.

A circular arrangement of the sensor elements 10 on the time piece ring permits to e.g. adjust the time by brushing the finger over the display in a circular fashion clockwise or anti-clockwise, as if it was intended to advance or turn back physical time piece hands manually (FIGS. 13*a* and 13*b*).

A further alternative possibility of input utilizes an integrated position sensor chip. In this case, an illuminated point is simulated by the time piece processor like an inertial element. If the time piece is shaken, the illuminated point in the display ring is likewise shaken to and fro. If the time piece is tilted, the illuminated point moves to the lowest locality of the ring (FIGS. 12*a* to 12*c*). If now e.g. each full hour is associated with a particular action (e.g. action "enter"=12 o'clock or action "set"=6 o'clock), precisely that action is performed where the illuminated point is situated when an input element is pressed. The time piece is thus able to perform many different actions using one and the same input element.

In order to save energy for the supply of the LEDs, an input process into the time piece may be performed in several stages: for example, by touching a sensor element or the time piece casing the actual display-sensing can be initiated, which then activates sensing of the LEDs, or may also be triggered by a shaking motion of the time piece.

The sensor elements of the time piece ring may also detect by resistance measurement whether the time piece is underwater and may in this event switch off outwardly-directed power supply via the sensor elements in order to prevent short-circuits.

Since the integrated position and acceleration sensor can also detect short impacts, like those occurring when tapping on the time piece ring, it is possible to trigger specific actions by various temporally-different tapping signals. In order to prevent operational errors, double-clicking known from operating a computer mouse may be used in order to indicate that thereafter an operation is to be performed. Double-clicking again resets the time piece from the previously selected mode to the normal state.

In the time piece ring or in the extension modules, respectively, further sensors 9 may be located which can measure magnetic fields (compass), for example, air pressure, temperature, humidity etc., can store data (dictating machine), record and play back music (MP3), perform remote control functions and can communicate with other electronic instruments by way of infrared or radio signals (Bluetooth).

In order to ensure fracture resistance of the time piece ring, the LED-display is preferably inserted into the groove of a steel-support-structure and cast into and sealed in the latter in watertight manner (FIG. 2). The support structure may be coated with other materials, such as, for example, plastics or paints, or may generally be surrounded by other materials 21, such as, for example, wood, stone, plastics or metals (FIG. 10).

The support structure may advantageously be composed of a plurality of sections 1 and 15 (FIGS. 2, 9*a*). These, when assembled, have a cross-section comprising a groove which accommodates the electronic printed circuit boards 2. The detailed transverse division of the support structure is performed according to principles of ease of manufacture in the sense that after inserting the electronic printed circuit boards 2 a last closure member mechanically fixes the printed circuit board in the ring. The support structure may also be manufactured from one single piece, for example by selective laser melt technology. In this case, the electronic printed circuit board 2 is inserted in the groove of the time piece ring 1 and fixed there by adhesive points; subsequent casting to fill up the groove fixes the printed circuit board mechanically in the ring.

The cross-section may take on various shapes (e.g. rectangular, circular, elliptical). The individual parts can be screwed, plugged, adhesively-bonded, joined together.

The annular printed circuit boards, which are inserted in the groove, consist preferably of a multi-layer material. They may be extended in the bulges of the time piece and comprise there on their underside a processor, quartz, condensers, sensors etc. On the upper side of the printed circuit boards light-emitting components are provided, preferably LEDs, preferably multi-colored LEDs, preferably RGB-LEDs (but also OLEDs, quantum point-LEDs etc.). If UV-emitting LEDs are used, plastics (quantum point-nano-materials) are fitted thereabove (embedded in the casting material), converting the UV-light into visible light.

The LEDs are either soldered discretely onto the printed circuit boards or also glued on and directly bonded to the printed circuit board. In a preferred arrangement (FIG. 22) RGB-SMD-LEDs 41 are used comprising a joint cathode or a joint anode. A special disentanglement of the annular multi-layer printed circuit board ensures that the LEDs can be placed next to one another as closely as possible without short circuits coming about between the connections 42 of the LEDs.

Over the annular printed circuit board further annular elements may be provided, for example thin metal masks 19 onto/into which e.g. time symbols or time markings or other patterns may be printed or milled (FIG. 2), or plastics lenses which concentrate the light of the LEDs or other optical elements (e.g. prisms, Fresnel lenses) or color filters, which, e.g. for increasing contrast, only allow the transmission of that color portion of the spectrum which is emitted by the respective LED there below, or grating.

All these elements, once they have been superimposed and fixed, are encased by casting in a transparent material, preferably a polymer plastics material which hardens under short-wave light. There are thus no air layers between the LEDs and the outside of the time piece, on the boundary surfaces of which the light coming from outside the time piece would otherwise be reflected, thereby reducing the contrast between LED-light and environment required for optimal readability.

The inside 17 of the groove 13 in the metal ring is flared towards the bottom and/or striated and/or otherwise roughened so that the polymer plastics material may anchor itself in a stable manner.

The inside of the (conical) groove may include time markings or time symbols 18 or may have cut into it or printed on other patterns.

The casting-plastics material may be tinted, preferably, for increasing the contrast, tinted dark or may have a reflective coating which is semi-transparent, comprise UV-active substances (or quantum point-nano-materials), or contain other optical materials (prisms, pigments, mirrors).

After curing the casting material may be ground and polished and/or provided with time markings. If the surface is ground to be convex, it can concentrate the light of the LEDs lying there below. The transparent casting material, due to its convexity, can thus take on the function of an optical (cylindrical) lens on the upper side and optically enlarge the illumination point or concentrate its light towards the viewer (FIG. 10).

By complete encasing by casting of the multi-layer printed circuit board with LEDs, processor and further electronic components the annular configuration becomes watertight.

Another modification is the close-fitting gluing into place of a conical glass ring 20. This glass ring represents a torus-shaped lens which is able to concentrate the light of the LED there below. The inside of the glass ring may have time markings engraved therein or printed on, the conical glass surfaces may likewise have time markings engraved therein or printed on.

Preferably, all electronic components of the time piece may be provided on the underside of the multi-layer printed circuit board. For a more cost-effective realization, the time piece ring includes a bulge 4 and 5 at the top and at the bottom, which can both accommodate further electronic components such as processor 6, condenser 7, sensors 8 as well as representing part of an articulation which is connected to a first upper and lower member of a time piece wrist strap 12 (FIG. 1).

The construction of the articulation can restrict the possible maximum rotary motion to a particular angle by way of an integrated abutment (FIG. 20) so that the maximum bending radius of flexible conductor tracks 37 and/or conductors passing through inside, is not exceeded.

In the interior of the time piece ring, center elements 31 and 33 may be placed which can be rapidly exchanged and which, apart from purely optical design functions, may also contain their own electronics and technical functions, e.g. stop watch, compass, thermometer, hydrometer, barometer, MP3-player, camera, Bluetooth. The center elements may be cylindrical (FIG. 17*a*) or may likewise have a ring shape (FIG. 17*b*). In order to attain an elegant design, the time piece should not have any notches or protuberances for fixing the center elements. For example, the center elements comprise a plurality of integrated neodym-magnets 32 on their periphery, whereby they are magnetically retained in the steel ring of the annular time piece, centering them automatically (16*a*), or comprise a spring mechanism, or are covered with a resilient material.

In the case of integrated electronics, the center elements may have their own battery. The power supply may, however, also take place via the annular time piece, preferably via the same spring contacts which center the center element in the annular time piece. A possible data exchange with the annular time piece is likewise performed via these spring contacts.

Since the wrist strap or clasp, respectively, is electrically connected to the time piece ring, they may, in turn, contain sensors and input or output elements (FIGS. 14, 15), for example, a date display.

In order to add to the time piece functions, the time piece ring, the clasp and the time piece strap may be designed as a modular system. For this purpose, power and data lines (FIGS. 18, 19*a* to 19*c*) are passed simultaneously to and through the individual elements (time piece ring, time piece strap, clasp, modules). As a result, independent input and output elements, sensors, processors may be contained in each of these modules.

All these individual elements may be exchanged by the user (FIG. 16*a*). This allows the time piece to be retrofitted with new modules 28, e.g. with more powerful accumulators or new sensors.

For the modules 28 to be interconnected in a watertight and flexible manner and to be exchanged by the user himself/herself, contacts 38 and 39 and articulations 40 are separate from one another: a watertight articulation guides the cables to a contact strip which can be opened. Modules can thus be exchanged at random; the wrist strap can be lengthened/shortened (FIG. 20).

A further possibility (preferred) for transmitting power between the modules is the use of flexible conductor tracks 37 which lie embedded between two protective layers. So as not to buckle these conductor tracks, the articulations, due to the design of the abutment, can only be moved by a limited angle (FIG. 21).

In order to attain fracture resistance of the time piece ring, the support structure may also be manufactured from flexible and resilient material. The structure must in this case also be cast into transparent, resilient material. The printed circuit boards then need to be manufactured from flexible material.

The time piece ring may also be used in other embodiments, apart from the wristwatch, for example as pocket watch 43 (FIG. 23), or as a finger ring 44 (FIG. 24). The time piece ring may also be built around other objects, for example on the periphery of the inside of spectacle lenses, so that the wearer of spectacles can comfortably read the time while this information is not visible to other persons. Although the wearer of spectacles 46 cannot focus on the illuminated points due to their extreme closeness, he/she can nevertheless recognize the position of the blurred points and can, therefore, detect the time (FIG. 25).

Substantially larger designs of the time piece ring are, however, also conceivable, e.g. as wall clock or grandfather clock 45 (FIG. 25). As a time piece ring according to the invention is very thin and slim, designs with substantially larger diameters—in contrast to conventional time pieces—may be realized, which can nevertheless be integrated in their environment.

The invention claimed is:

1. A time piece which is electronically controlled, said time piece comprising:

a casing having a defined opening at one or more localities; and at least one annular display field being formed by illuminating means and at least one electronic printed circuit board in communication with said illuminating means;

wherein said casing further comprising an electronic device for realizing display positions between two display points by anti-aliasing;

wherein said illuminating means are switchable in orbital fashion on a ring, wherein that at least one annular row of at least 60 light-emitting elements by way of the state of illumination of individual light-emitting elements indicates at least time parameters "hour" and "minute";

wherein said electronic printed circuit board is provided on one end face of said ring, and that the displays of hours, and minutes are differentiated from one another by an means selected from the group consisting of illumination design, an illumination color, its brightness, and the illumination distribution onto a plurality of adjoining light-emitting elements.

2. The time piece according to claim 1, wherein said casing being at least one annular member comprising a groove, in which said electronic printed circuit board and said light-emitting elements are inserted and fixed, said electronic printed circuit board and said light-emitting elements being enclosed by a transparent material.

3. The time piece according to claim 2 further comprising a brightness sensor provided in said casing for adapting the brightness of said annular display field to the ambient light in said casing, wherein illumination contrast being independent of ambient brightness, and wherein said hour parameter is indicated by a fine scale including more than 12 positions.

4. The time piece according to claim 3 further comprising a contrast-enhancing, dark, transparent material or a semi-transparent reflective layer provided over said light-emitting elements, and wherein said light-emitting elements are formed by multi-colored SMD-LEDs.

5. The time piece according to claim 2, wherein said transparent material is a transparent plastics material, by which said electronic printed circuit board is enclosable watertight by casting, and wherein said transparent plastics material comprising color filters embedded therein, which only allow transmission of a light spectrum of a particular said light-emitting element therebelow.

6. The time piece according to claim 5, wherein said transparent plastics material having embedded therein at least one optical element selected from the group consisting of minors, prisms, diffusers, and lenses, and wherein said transparent plastics material having an upper side exposed from said casing which is configured convexly in order to concentrate the light of said light-emitting elements therebelow.

7. The time piece according to claim 6 further comprising at least one mask which is printed on and provided with time markings, said mask being positioned over said light-emitting elements.

8. The time piece according to claim 7, wherein said groove of said casing features side walls provided with markings.

9. The time piece according to claim 8 further comprising an electronic position sensor for determining a direction of gravity, and a battery, said electronic position sensor being accommodated in said casing and at least controls the brightness of said annular display field in accordance with movement of said time piece, said battery being integrated in one of a wrist strap, and a clasp and electronically connected to said casing.

10. The time piece according to claim 9, wherein said wrist strap is connected electrically to said clasp, and wherein additional input and output elements are accommodated in one of said wrist strap and said clasp.

11. The time piece according to claim 10 further comprising electronic devices for measuring temperature, magnetic field, air pressure, and humidity of ambient air.

12. The time piece according to claim 11, wherein said annular display flied is opto-electronically adapted as a touch-sensitive field, by which a setting of a displayed information is performed, and wherein operation of said time piece is to be performed by measurement of a reverse bias current of said light-emitting elements, which accordingly function as reflex light barriers.

13. The time piece according to claim 12, wherein said electronic position sensor is connected to a processor, and input of desired information takes place by orientation of said time piece in a gravitational field.

14. The time piece according to claim 12, wherein said electronic position sensor is connected to a processor, and input of desired information is brought about by tapping onto said casing.

15. The time piece according to claim 12 further comprising a disk-shaped element inserted into a center of said time piece and held there temporarily by one of permanent magnets, and springs which, by way of contacts on said casing exchanges data, is supplied with electric energy by way of said contacts on said casing and which accommodates said integrated electronic devices.

16. The time piece according to claim 1, wherein said casing is provided on an upper side of a finger ring.

17. The time piece according to claim 1, wherein said casing is comprised of at least two sections that when assembled, have a cross-section comprising a groove which accommodates said electronic printed circuit board.

18. A time piece comprising:

a casing in the form of a ring having end faces, said casing defining an opening at one or more localities, said casing having a defined annular groove therein featuring side walls;

at least one annular display field being formed by at least one annular row of at least 60 light-emitting elements and an electronic printed circuit board in communication with said annular row of light-emitting elements, said light-emitting elements being receivable in said groove of said casing, said light-emitting elements being switchable in orbital fashion on said ring, wherein that by way of the state of illumination of individual light-emitting elements indicates at least the time parameters "hour" and "minute";

a transparent material casted and enclosing said electronic printed circuit board and light-emitting elements in said groove;

a brightness sensor provided in said casing for adapting a brightness of said annular display field to ambient light in said casing, wherein illumination contrast being independent of ambient brightness;

an electronic device for realizing display positions between two display points by anti-aliasing;

an electronic position sensor for determining a direction of gravity, said electronic position sensor being accommodated in said casing;

a wrist strap attachable and electronically connected to said casing; and a battery in the form of a rechargeable flexible accumulator integrated in a clasp of said wrist strap;

wherein said electronic printed circuit board is provided on one of end face of said ring, and that the displays of hours and minutes are differentiated from one another by a means selected from the group consisting of illumination design, an illumination color, brightness, and an illumination distribution onto a plurality of adjoining light-emitting elements.

19. A time piece system comprising:

a casing provided on an upper side of a ring having end faces, said casing defining an opening at one or more localities, and having a defined annular groove therein featuring side walls;

at least one annular display field being formed by at least one annular row of at least 60 light-emitting elements and an electronic printed circuit board in communication with said annular row of light-emitting elements, said light-emitting elements being receivable in said groove of said casing, said light-emitting elements being switchable in orbital fashion on said ring, wherein that by way of a state of illumination of individual light-emitting elements indicates at least the time parameters "hour" and "minute" and "second";

a transparent material casted and enclosing said electronic printed circuit board and light-emitting elements in a watertight manner in said groove, said transparent material being a transparent plastics material, said transparent plastics material comprising color filters embedded therein, which allow transmission of a light spectrum of a particular said light-emitting element therebelow;

at least one mask printed on and provided with time markings, said mask being positioned over said light-emitting elements;

a wrist strap attachable and electronically connected to said casing;

a battery in the form of a rechargeable flexible accumulator integrated in a clasp electronically connected to said wrist strap; and a disk-shaped element inserted into a center of said time piece and held there temporarily by permanent magnets which, by way of contacts on said casing exchanges data, is supplied with electric energy by way of said contacts on said casing and which accommodates said integrated electronic devices;

wherein said electronic printed circuit board is provided on one end face of said ring, and that the displays of hours, minutes and seconds are differentiated from one another by an means selected from the group consisting of illumination design, an illumination color, brightness, and an illumination distribution onto a plurality of adjoining light-emitting elements.

* * * * *